US010325745B2

(12) United States Patent
Lasini et al.

(10) Patent No.: US 10,325,745 B2
(45) Date of Patent: Jun. 18, 2019

(54) MULTIPLE ELEMENT FUSE

(71) Applicant: Littelfuse, Inc., Chicago, IL (US)

(72) Inventors: Derek Lasini, Schaumburg, IL (US); Michael Schlaak, Morton Grove, IL (US); Matthew Miller, Lombard, IL (US); Matthew Yurkanin, Mount Prospect, IL (US)

(73) Assignee: LITTELFUSE, INC., Chicago, IL (US)

( * ) Notice: Subject to any disclaimer, the term of this patent is extended or adjusted under 35 U.S.C. 154(b) by 15 days.

(21) Appl. No.: 15/713,892

(22) Filed: Sep. 25, 2017

(65) Prior Publication Data

US 2019/0096622 A1 Mar. 28, 2019

(51) Int. Cl.

| | |
|---|---|
| ***H01H 85/12*** | (2006.01) |
| ***H01H 85/143*** | (2006.01) |
| ***H01H 85/10*** | (2006.01) |
| ***H01H 85/36*** | (2006.01) |
| ***H01H 85/56*** | (2006.01) |
| *H01H 69/02* | (2006.01) |

(52) U.S. Cl.

CPC ..... *H01H 85/143* (2013.01); *H01H 85/10* (2013.01); *H01H 85/12* (2013.01); *H01H 85/36* (2013.01); *H01H 85/56* (2013.01); *H01H 69/02* (2013.01)

(58) Field of Classification Search

CPC ..... H01H 85/08; H01H 85/10; H01H 85/12; H01H 85/143; H01H 69/02; H01H 85/36; H01H 85/56

USPC ..... 337/187, 293

See application file for complete search history.

(56) References Cited

U.S. PATENT DOCUMENTS 1,413,997 A * 4/1922 Schweitzer ..... H01H 9/44 337/273
1,604,477 A * 10/1926 Ogle ..... H01H 85/0456 337/229
2,720,567 A * 10/1955 Lewis ..... H01H 85/10 337/295
3,189,712 A * 6/1965 Kozacka ..... H01H 85/0456 337/158
3,291,943 A 12/1966 Kozacka (Continued)

FOREIGN PATENT DOCUMENTS

GB 669378 A 4/1952

OTHER PUBLICATIONS

International Search Report for the International Patent Application No. PCT/US2018/052556, dated Dec. 13, 2018.

*Primary Examiner* — Jacob R Crum

(57) ABSTRACT

Approaches herein provide a multiple element fuse including a first fuse element having a first pair of terminals joined by a first fusible link, and a second fuse element including a second pair of terminals joined by a second fusible link. The first pair of terminals may be directly physically coupled with the second pair of terminals. In some embodiments, the first pair of terminals and the second pair of terminals are stacked relative to one another and joined by one or more linking elements, thus causing the first fusible link and the second fusible link to extend parallel to one another. In some embodiments, a first plurality of terminal pairs are integrally linked adjacent one another along a same plane, and then subsequently coupled to a second plurality of terminal pairs.

17 Claims, 8 Drawing Sheets

(56) References Cited

U.S. PATENT DOCUMENTS

| | | | | |
|---|---|---|---|---|
| 3,394,333 | A * | 7/1968 | Jacobs, Jr. | H01H 85/10 337/229 |
| 5,905,426 | A | 5/1999 | Douglass | |
| 9,697,976 | B2 * | 7/2017 | Katarki | H01H 85/12 |
| 2003/0001716 | A1 * | 1/2003 | Kaltenborn | H01H 85/046 337/273 |
| 2006/0012934 | A1 * | 1/2006 | Faulkner | H01H 85/044 361/104 |
| 2012/0139687 | A1 * | 6/2012 | Plesca | H01H 85/0026 337/142 |
| 2013/0009744 | A1 | 1/2013 | Douglass | |
| 2015/0371803 | A1 | 12/2015 | Hosomizo et al. | |

* cited by examiner

MULTIPLE ELEMENT FUSE

FIELD OF THE DISCLOSURE

The disclosure relates generally to the field of protection device components and, more specifically, to multiple element fuses.

BACKGROUND OF THE DISCLOSURE

Fuses are overcurrent protection devices for electrical circuitry, and are widely used to protect electrical power systems and prevent damage to circuitry and associated components when specified circuit conditions occur. A fusible element or assembly is coupled between terminal elements of the fuse, and when specified current conditions occur, the fusible element or assembly, disintegrates, melts or otherwise structurally fails, and opens a current path between the fuse terminals. Line side circuitry may therefore be electrically isolated from load side circuitry through the fuse, preventing possible damage to load side circuitry from overcurrent conditions.

Fuses may be single or multiple-element, the later having performance advantages but being more complicated and costly to manufacture. This is due in part to having multiple parts, which requires complicated fixturing and increases the possibility for error. In view of these challenges, improvements in multiple element electrical fuses are desired.

SUMMARY

In one approach according to embodiments of the disclosure, a multiple element fuse comprising a first fuse element including a first pair of terminals joined by a first fusible link, and a second fuse element including a second pair of terminals joined by a second fusible link, wherein the first pair of terminals is directly physically coupled with the second pair of terminals.

In another approach according to embodiments of the disclosure, a method of forming a multiple element fuse includes providing a first fuse element including a first pair of terminals joined by a first fusible link, providing a second fuse element including a second pair of terminals joined by a second fusible link, and directly coupling the first pair of terminals to the second pair of terminals such that the first pair of terminals and the second pair of terminals are oriented parallel to one another along different planes.

In yet another approach according to embodiments of the disclosure, a multiple element fuse includes a first fuse element including a first pair of terminals joined by a first fusible link, and a second fuse element including a second pair of terminals joined by a second fusible link, wherein the first pair of terminals and second pair of terminals each include an inner surface and an outer surface, and wherein the inner surfaces of the first pair of terminals and the second pair of terminals are parallel and in directly physical contact with one another.

Figure 1:
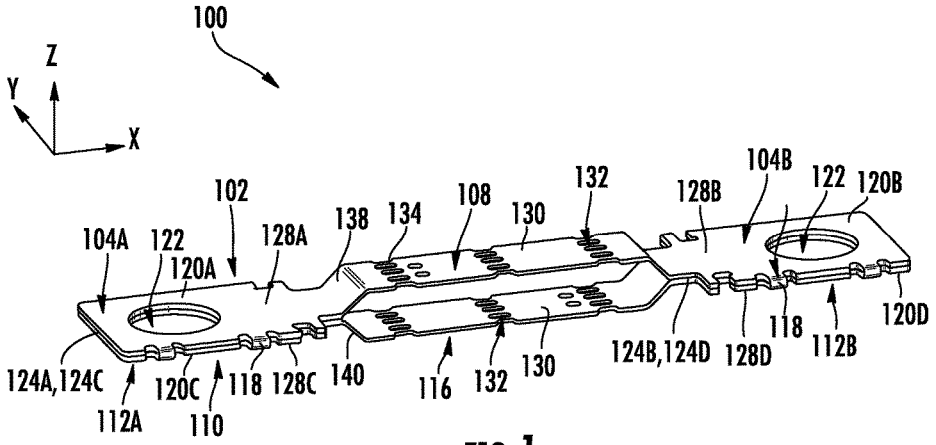
FIG. 1 is perspective view of a multiple element fuse in accordance with embodiments of the present disclosure.

The drawings are not necessarily to scale. The drawings are merely representations, not intended to portray specific parameters of the disclosure. The drawings are intended to depict exemplary embodiments of the disclosure, and therefore are not be considered as limiting in scope. In the drawings, like numbering represents like elements.

DETAILED DESCRIPTION

Various approaches in accordance with the present disclosure will now be described more fully hereinafter with reference to the accompanying drawings, where embodiments of a device and method are shown. The device(s) and method(s) may be embodied in many different forms and are not be construed as being limited to the embodiments set forth herein. Instead, these embodiments are provided so this disclosure will be thorough and complete, and will fully convey the scope of the system and method to those skilled in the art.

For the sake of convenience and clarity, terms such as "top," "bottom," "upper," "lower," "vertical," "horizontal," "lateral," and "longitudinal" will be used herein to describe the relative placement and orientation of these components and their constituent parts, with respect to the geometry and orientation of a component of a semiconductor manufacturing device as appearing in the figures. The terminology will include the words specifically mentioned, derivatives thereof, and words of similar import.

As used herein, an element or operation recited in the singular and proceeded with the word "a" or "an" are understood as potentially including plural elements or operations as well. Furthermore, references to "one embodiment" of the present disclosure are not intended to be interpreted as precluding the existence of additional embodiments also incorporating the recited features.

Furthermore, in the following description and/or claims, the terms "on," "overlying," "disposed on" and "over" may be used in the following description and claims. "On," "overlying," "disposed on" and "over" may be used to indicate that two or more elements are in direct physical contact with each other. However, "on,", "overlying," "disposed on," and over, may also mean that two or more elements are not in direct contact with each other. For example, "over" may mean that one element is above another element but not contact each other and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

As will be described in detail herein, embodiments of the present disclosure include multiple element fuses having a first fuse element including a first pair of terminals joined by a first fusible link, and a second fuse element including a second pair of terminals joined by a second fusible link. The first pair of terminals may be directly physically coupled with the second pair of terminals. In some embodiments, the first pair of terminals and the second pair of terminals are stacked relative to one another and joined by one or more linking elements, thus causing the first fusible link and the second fusible link to extend parallel to one another. In some embodiments, a first plurality of terminal pairs are integrally linked adjacent one another along a same plane, and then subsequently coupled to a second plurality of terminal pairs.

As described above, multiple-element fuses have performance advantages over single element fuses. To overcome deficiencies of the prior art, embodiments of the present disclosure simplify the design and manufacture of a dual element fuse into one part that is simpler to assemble and minimizes inventory. In some embodiments, the raw material used to manufacture the multiple-element fuse is first machined to the proper thickness, or starts out at the proper raw material thickness, and is then formed to the intended shape. The multiple-element fuse may then be prepared by adding a solder overlay before being formed into a final shape/structure. At least one technical benefit of this design process is that the fuse solder operation occurring before forming the multiple-element fuse into its final shape is simplified, and that multiple fuse elements are formed at the same time, thus eliminating length variation between each individual fuse elements. Having the terminal and element section as one part also advantageously minimizes handling of the fragile, formed element section. Although not limited to any particular implementation, many higher amperage hybrid electrical vehicles (HEV) may benefit from the multiple-element fuse of the present disclosure.

Figure 2:
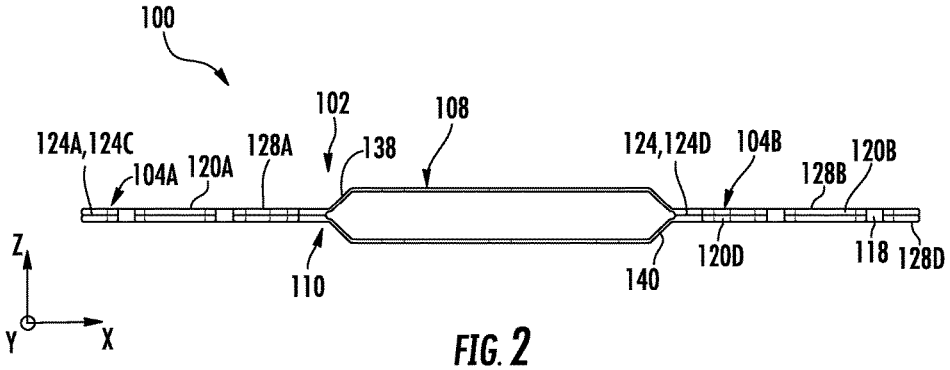
FIG. 2 is a side view of the multiple element fuse of FIG. 1 in accordance with embodiments of the present disclosure.

Referring now to FIGS. 1-2, a multiple-element fuse 100 (hereinafter "fuse") according to some embodiments of the present disclosure will be described in greater detail. As shown, the fuse 100 includes a first fuse element 102 including a first pair of terminals 104A-B joined by a first fusible link 108, and a second fuse element 110 including a second pair of terminals 112A-B joined by a second fusible link 116. As shown, the first pair of terminals 104A-B are directly physically coupled with the second pair of terminals 112A-B, and joined together by one or more linking elements 118, which are integrally formed with the first and second pairs of terminals 104A-B and 112A-B. In some embodiments, the first and second fuse elements 102, 110 may be copper or a copper alloy exhibiting good conductivity and malleability.

The first and second pairs of terminals 104A-B and 112A-B may include terminal bodies 120A-B each having an opening 122 formed therein. The terminal bodies 120A-B are generally flat and include respective inner surfaces 124A-D and outer surfaces 128A-D, wherein the inner surfaces 124A-B of the first pair of terminals 104A-B and the inner surfaces 124C-D of the second pair of terminals 112A-B are in parallel abutment and/or in direct physical contact with one another. As shown, the terminal bodies 120A-D further including adjacent edges connecting inner surfaces 124A-D and outer surfaces 128A-D, wherein the linking element 118 is integrally formed with the edges. It will be appreciated that the terminal bodies 120A-D are not limited to any particular type or shape. For example, various types of terminal sections may include blade-shaped terminal sections and box-shaped terminal sections (insertion types of terminal sections) structured to cover a connection terminal.

In some embodiments, the first fusible link 108 and the second fusible link 116 extend parallel, or substantially parallel, to one another. Each of the fusible links 108, 116 may include a plurality of solid sections 130 joined together by electrically conductive bridges 132, which may be a result of multiple openings 134 being formed through the first and second fusible links 108, 116. In various embodiments, the first and second fusible links 108, 116 may have a same or reduced thickness as compared to respective terminals 104A-B and 112A-B. As shown, each fusible link 108, 116 further includes respective shoulder regions 138 and 140 connected to terminals 104A-B and 112A-B. In various embodiments, the shoulder regions 138 may have a bent or curved shape, thus causing the first pair of terminals 104A-B and the first fusible link 108 to extend parallel to one another along different x-y planes. Similarly, the shoulder regions 140 cause the second pair of terminals 112A-B and the second fusible link 116 to extend parallel to one another along different x-y planes. It will be appreciated that the fusible links 108 and 116 of the present embodiment are not limited to any specific shape or type. For example, each fusible link 108, 116 may have a portion having a smaller cross-section, and/or an area having a lower melting point, such as tin, silver, lead, nickel, or an alloy thereof.

Figure 3:
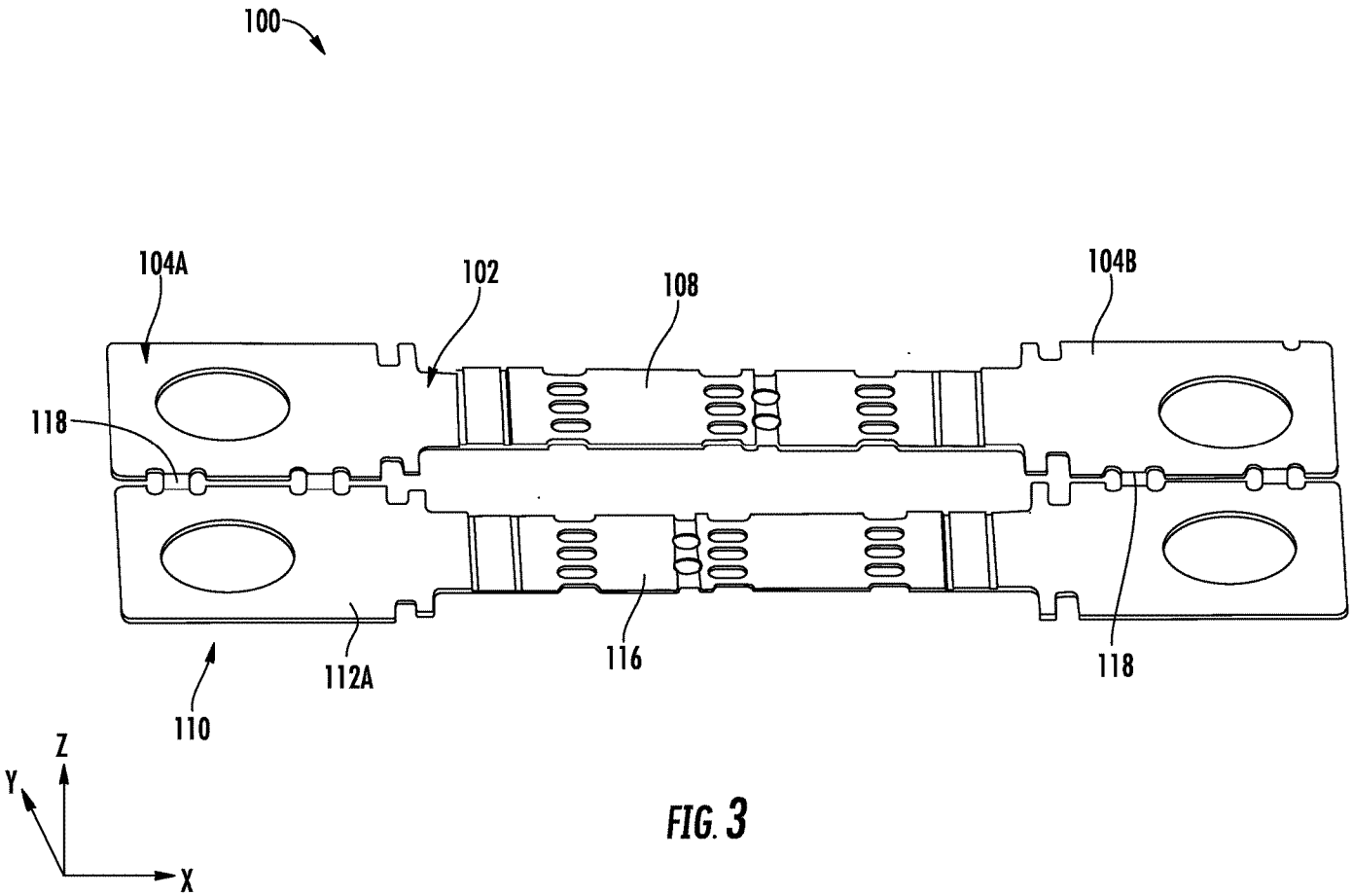
FIG. 3 is a perspective view of a multiple element fuse at an initial processing stage in accordance with embodiments of the present disclosure.
Figure 4:
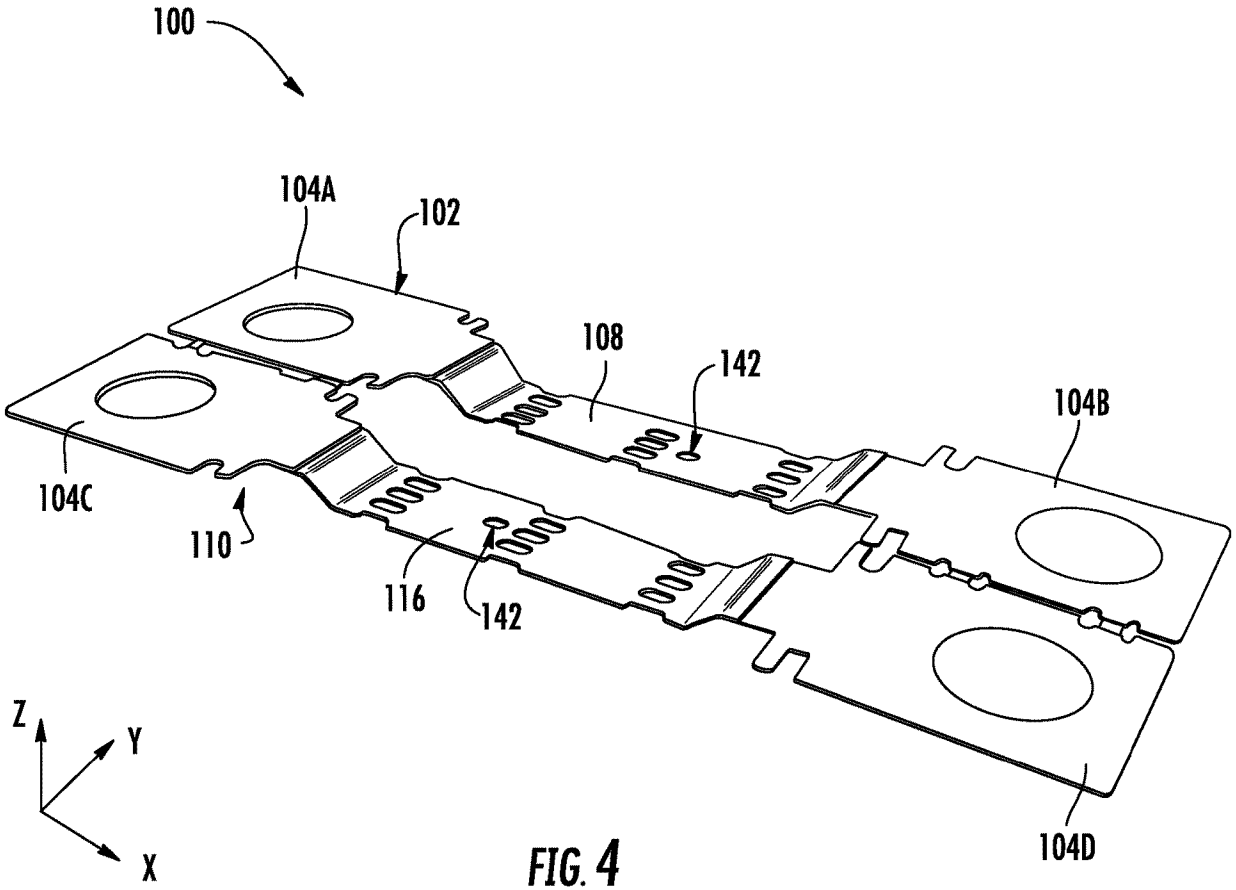
FIG. 4 is a perspective view of the multiple element fuse of FIG. 3 following a further processing step in accordance with embodiments of the present disclosure.
Figure 5:
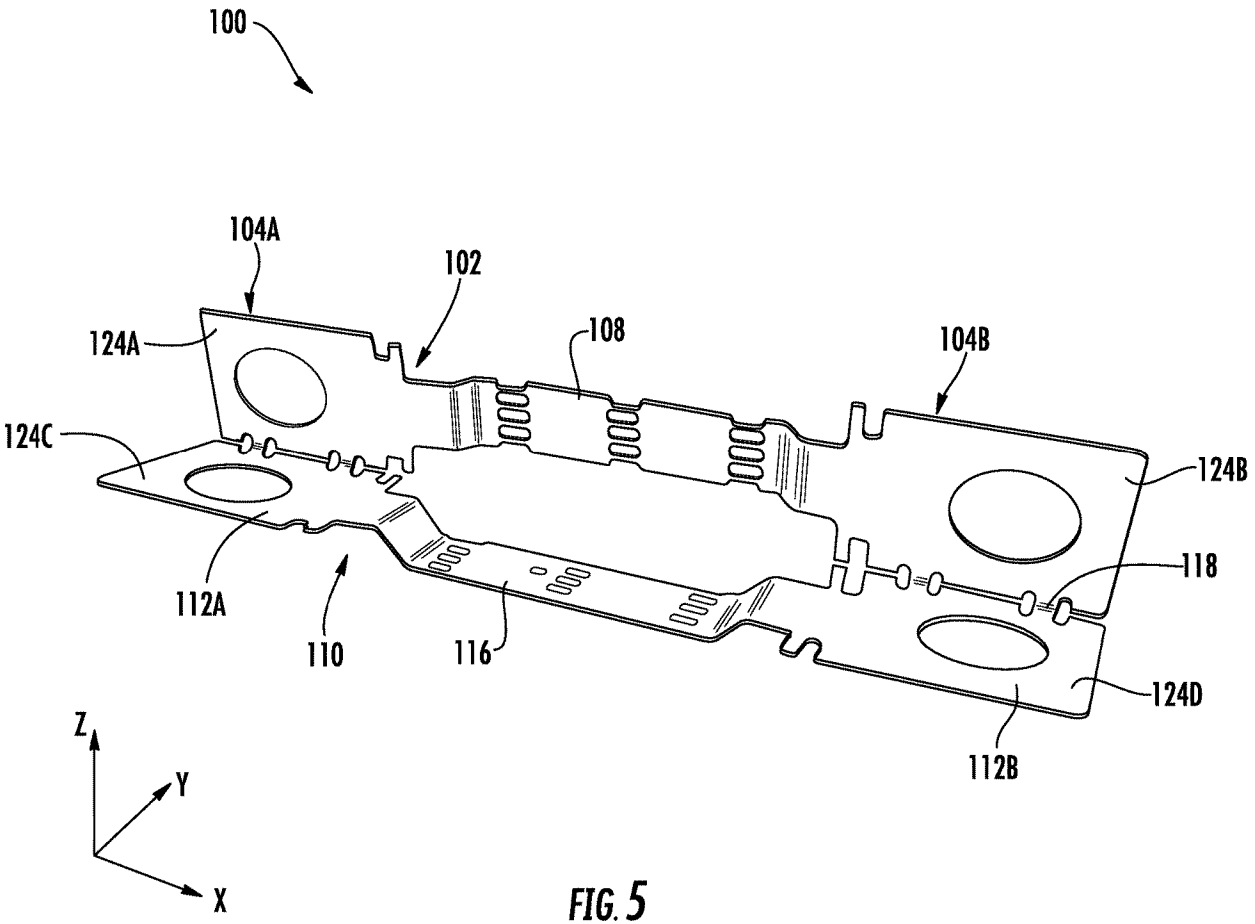
FIG. 5 is a perspective view of the multiple element fuse of FIG. 3 following a further processing step in accordance with embodiments of the present disclosure.

Turning now to FIGS. 3-5, a method for forming the fuse 100 according to embodiments of the disclosure will be described in greater detail. As shown in FIG. 3, the method may include providing the first fuse element 102 including the first pair of terminals 104A-B joined by the first fusible link 108, and providing the second fuse element 110 including the second pair of terminals 112A-B joined by the second fusible link 116. In some embodiments, the first fuse element 102 and the second fuse element 110 are initially arranged adjacent one another, along a same plane, after being machined/manufactured from a single piece of material. The first and second fuse elements 102, 110 may be coupled together by just the linking elements 118, which may extend between interior edges of each of the first and second pairs of terminals 104A-B, 112A-B.

Next, as shown in FIG. 4, the shape of the first and second fuse elements 102, 110 may be modified by bending shoulder regions 138 and 140 connected to respective terminals 104A-B and 112A-B. In some embodiments, the shape of the first and second fuse elements 102, 110 depends on, for example, an application of the fuse 100, a fuse element type, and a desired rated current. To obtain material formed into the developed shape of the fuse 100, a stamping tool having a cutting blade conforming to this developed shape may be used. In some embodiments, the terminals and the fusible links may be individually obtained through different processes.

As shown, after bending shoulder regions 138 and 140, the first and second pairs of terminals 104A-B, 112A-B extend adjacent one another along a first plane, while the first and second fusible links 108, 116 extend along a second plane. Solder holes 142 through each of the fusible links 108 and 116 may then be filled with a solder material (not shown), and the first and second fuse elements 102, 110 may be stacked by folding the linking elements 118, as shown in FIG. 5. In exemplary embodiments, the inner surface 124A of the first terminal 104A is brought toward the inner surface 124C of the second terminal 112A, and the inner surface 124B of the first terminal 104B is brought towards the inner surface 124D of the second terminal 112B. Once the first and second fuse elements 102 and 110 are in place, for example as shown in FIGS. 1-2, the first pair of terminals 104A-B are directly physically coupled to, and/or directly adjacent and in abutment with, the second pair of terminals 112A-B. In some embodiments, the first and second pairs of terminals 104A-B, 112A-B are secured together, for example, by laser welding, spot welding, and/or ultrasonic welding. As shown, the first pair of terminals 104A-B and the second pair of terminals 112A-B are stacked and oriented parallel to one another, along different x-y planes. It will be appreciated that the length and thickness of the linking elements 118 is selected to permit the folding and stacking of the first and second fuse elements 102, 110.

Figure 6:
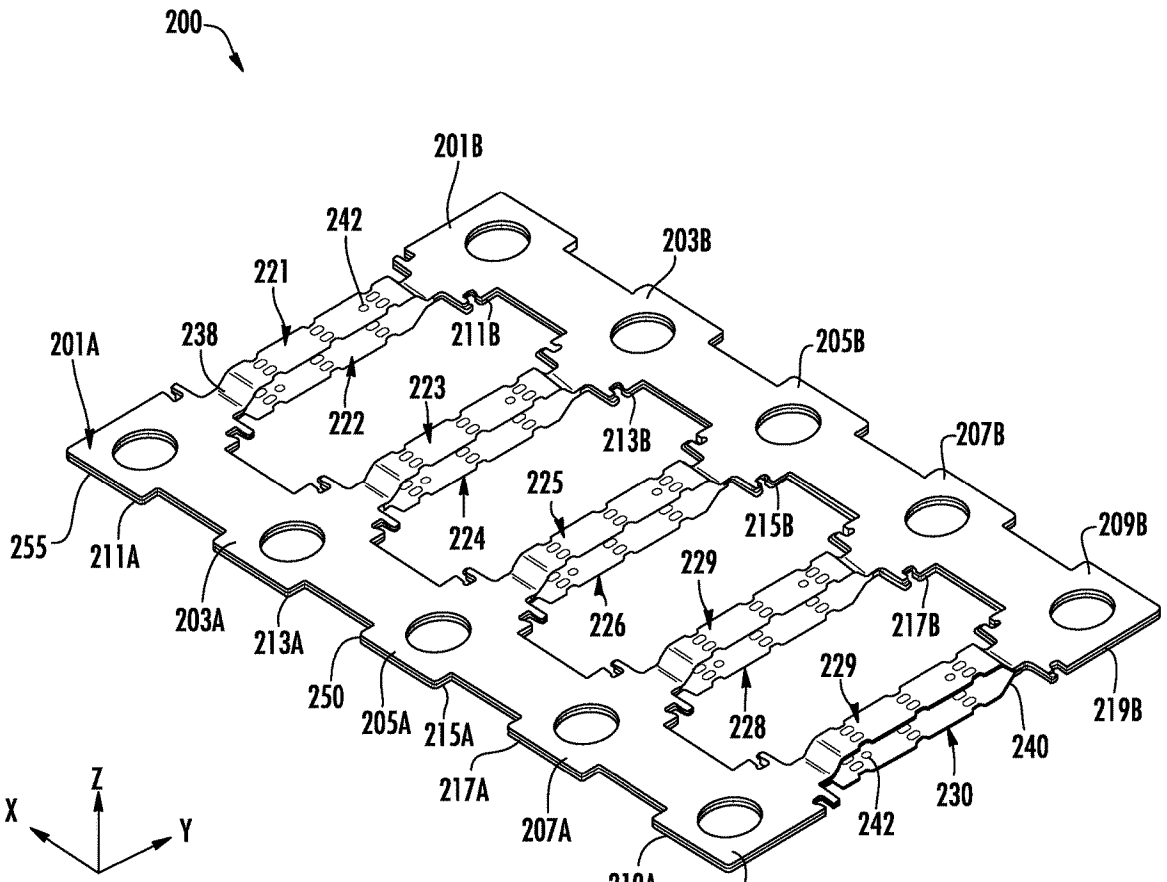
FIG. 6 is perspective view of a 5-fuse element array in accordance with embodiments of the present disclosure.
Figure 7:
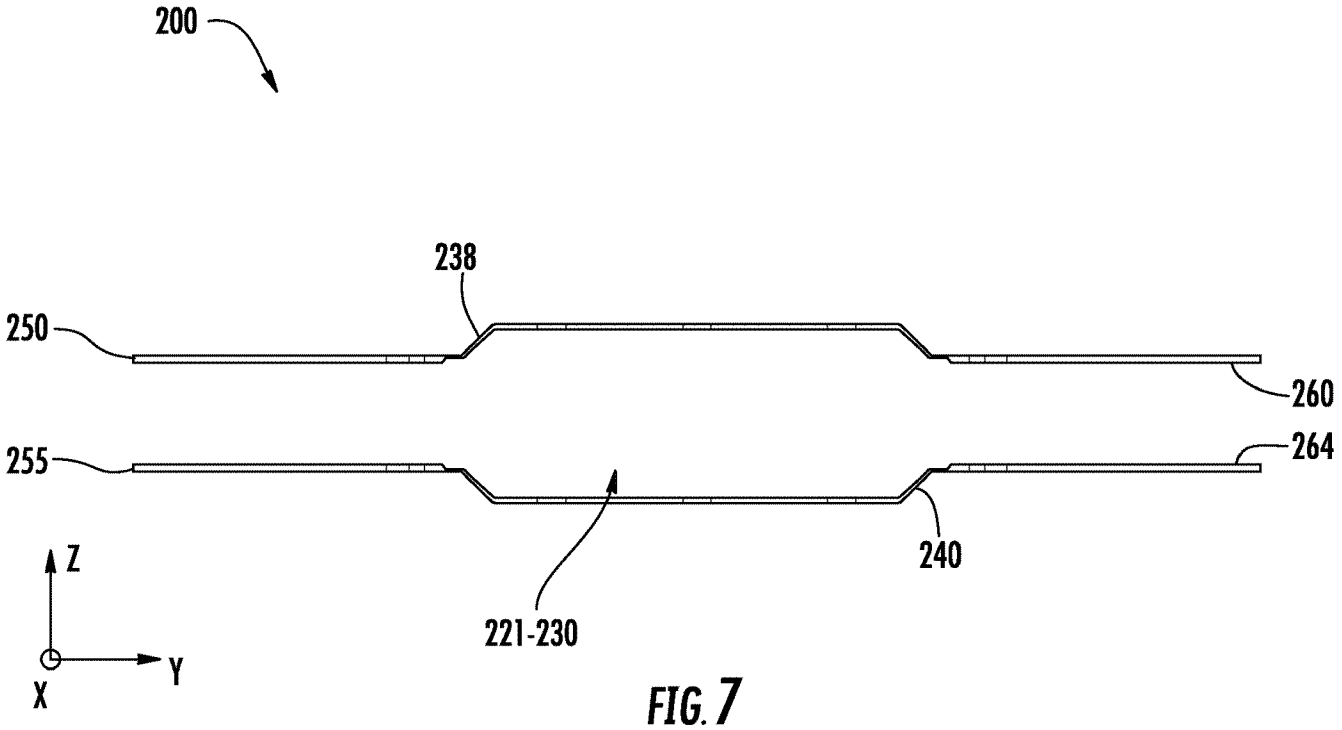
FIG. 7 is an exploded side view of the multiple element fuse of FIG. 6 in accordance with embodiments of the present disclosure.

Turning now to FIGS. 6-7, a multiple-element fuse 200 (hereinafter "fuse") according to some embodiments of the present disclosure will be described in greater detail. In this embodiment, the fuse 200 may be a 5-fuse element array, e.g., used for mass production. The fuse 200 allows assembly of 5 fuses at once on a fixture by removing square sections between each terminal once mounted to a fixture. One will appreciate, however, as few as two single fuse elements may be stacked atop each other to make one fuse, or may be greater than the 5 fuses per array shown in FIG. 6. Various other embodiments may stack 3, 4, 5, etc. fuse elements and terminals atop one another to make a multiple element fuse, wherein each may be formed differently to keep the fusing elements separated within the fuse body.

As shown, the fuse 200 is a dual element fuse with multiple fuses stacked atop one another. For example, the fuse 200 includes a first layer 250 attached to a second layer 255, both of which may be copper or a copper alloy exhibiting good conductivity and bending and spreading performances. The first layer 250 may include a first plurality of pairs of terminals 201A-B, 203A-B, 205A-B, 207A-B, and 209A-B integrally coupled together and extending along a same plane. Meanwhile, the second layer 250 may include a second plurality of pairs of terminals 211A-B, 213A-B, 215A-B, 217A-B, and 219A-B integrally coupled together and extending along a same plane.

The first and second layers 250, 255 include a plurality of fusible links 221-230 extending between respective terminal pairs. In some embodiments, the fusible links 221, 223, 225, 227, and 229 of the first layer 250 are parallel to one another, for example, along a length (i.e., the x-direction) of the fuse 200. Similarly, the fusible links 222, 224, 226, and 228 of the second layer 250 are spaced apart and parallel to one another along the length of the fuse 200. Meanwhile, the fusible links 221 and 222, 223 and 224, etc., are spaced apart and parallel to each other along the z-direction.

During manufacture/assembly of the fuse 200, each of the first and second layers 250 and 255 may be provided as a separate piece of material. The terminals and fusible links of each of the first and second layers 250 and 255 may then be machined or formed. Initially, the terminals and the fusible links of the first layer 250 may be arranged along a same plane, and the terminals and the fusible links of the second layer 255 may be provided along another plane. The shape of the plurality of fusible links 221-230 may then be modified by bending one or more of the shoulder regions 238 and 240 of the plurality of fusible links 221-230. Solder holes 242 through each of the fusible links 221-230 may then be filled with a solder material (not shown), and the first and second layers 250, 255 may be stacked. In exemplary embodiments, an inner surface 260 of the first layer 250 is secured to the inner surface 264 of the second layer 255, for example, by laser welding, spot welding, and/or ultrasonic welding.

Figure 8:
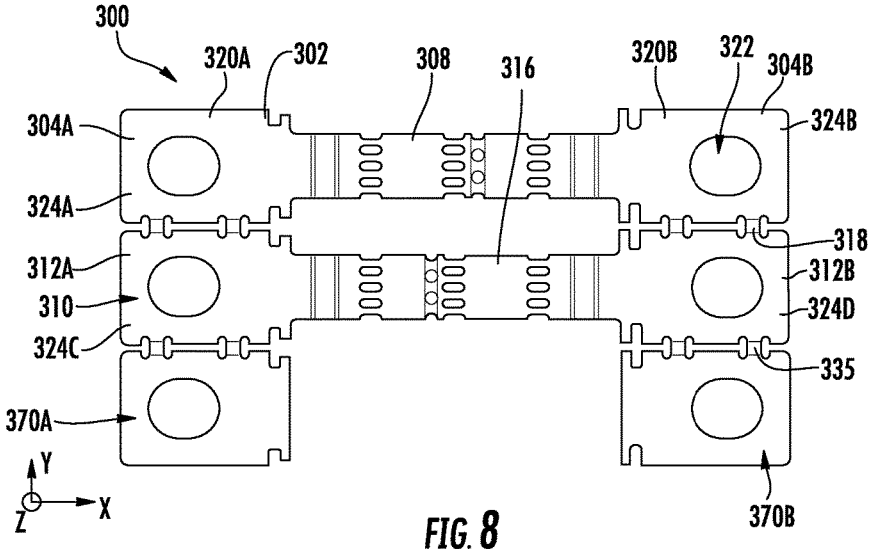
FIG. 8 is top view of a multiple element fuse in accordance with embodiments of the present disclosure.
Figure 9:
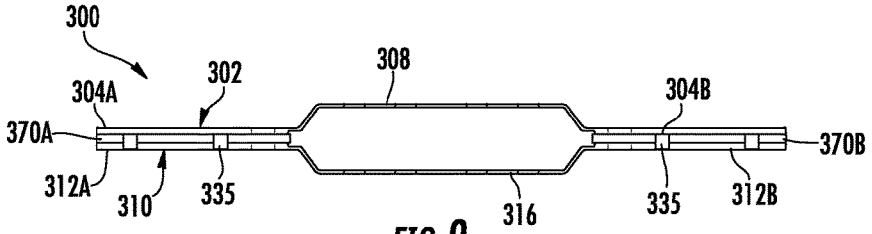
FIG. 9 is side view of the multiple element fuse of FIG. 8 following formation in accordance with embodiments of the present disclosure.
Figure 10:
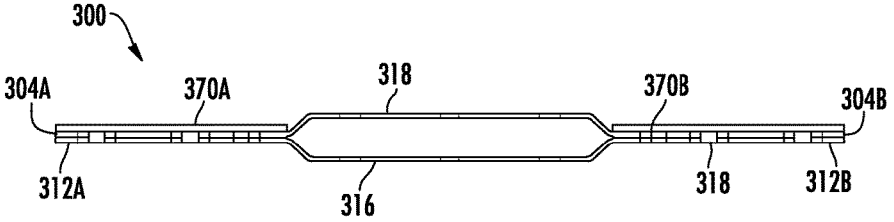
FIG. 10 is side view of the multiple element fuse of FIG. 8 following formation in accordance with embodiments of the present disclosure.

Turning now to FIGS. 8-10, a multiple-element fuse 300 (hereinafter "fuse") according to some embodiments of the present disclosure will be described in greater detail. As shown, the fuse 300 includes a first fuse element 302 including a first pair of terminals 304A-B joined by a first fusible link 308, and a second fuse element 310 including a second pair of terminals 312A-B joined by a second fusible link 316. As shown, the first pair of terminals 304A-B are directly physically coupled with the second pair of terminals 312A-B, for example, by one or more linking elements 318, which are integrally formed with the first and second pairs of terminals 304A-B and 312A-B. In other embodiments, no separate linking elements join the first pair of terminals 304A-B with the second pair of terminals 312A-B. The first and second pairs of terminals 304A-B and 312A-B may include respective terminal bodies 320A-D each having an opening 322 formed therein. The terminal bodies 320A-D are generally flat and include respective inner surfaces 324A-D, wherein the inner surfaces 324A-B of the first pair of terminals 304A-B and the inner surfaces 324C-D of the second pair of terminals 312A-B may be parallel to one another once formed. As shown, the terminal bodies 320A-D further include adjacent edges connecting inner surfaces 324A-D via the linking elements 318.

The fuse 300 may further include a third pair of terminals 370A-B directly physically coupled with at least one of the first pair of terminals 304A-B and the second pair of terminals 312A-B. In the embodiment shown, the third pair of terminals 370A-B is directly coupled to the second pair of terminals 312A-B by a set of linking elements 335. In other embodiments, no separate linking element(s) joins the third pair of terminals 370A-B with the first pair of terminals 304A-B and/or the second pair of terminals 312A-B. In some embodiments, the third pair of terminals 370A-B may not be joined together by a fusible link. Instead, during assembly, the third pair of terminals 370A-B may be folded about the linking elements 335 and sandwiched between the first pair of terminals 304A-B and the second pair of terminals 312A-B, for example as demonstrated in FIG. 9. In yet other embodiments, the third pair of terminals 370A-B may be in direct contact with an outer surface of either the first pair of terminals 304A-B or the second pair of terminals 312A-B, as demonstrated in FIG. 10. It will be appreciated that additional terminal layers may be provided to further increase the thickness and strength of this portion of the fuse 300. For example, as many as four or more terminal layers may be stacked atop one another (e.g., in the z-direction) in other embodiments. Furthermore, it'll be appreciated that the third pair of terminals 370A-B may be devoid of any linking elements (e.g., linking elements 335) and, instead, may be directly coupled with at least one of the first pair of terminals 304A-B and the second pair of terminals 312A-B.

Figure 11:
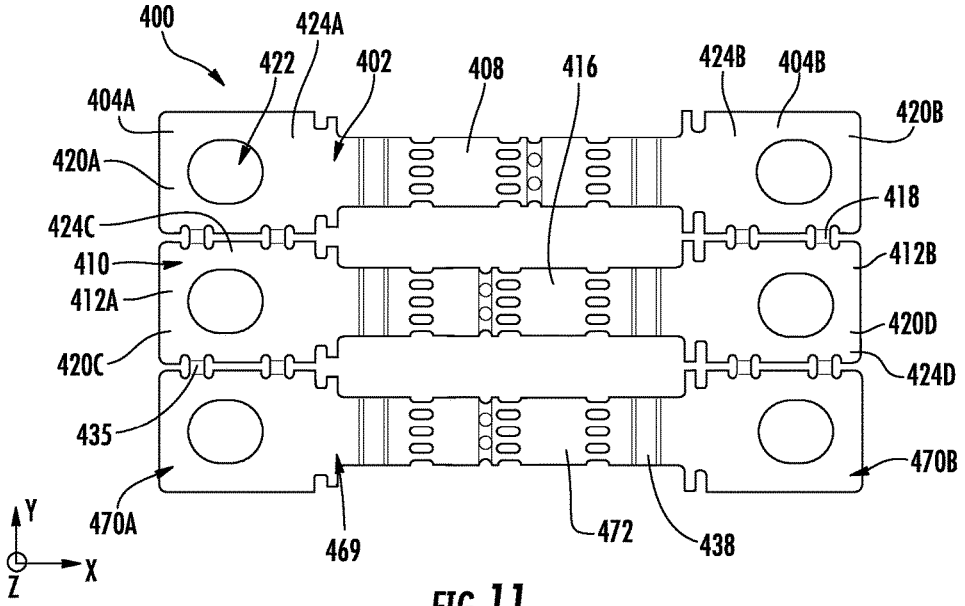
FIG. 11 is top view of a multiple element fuse in accordance with embodiments of the present disclosure.
Figure 12:
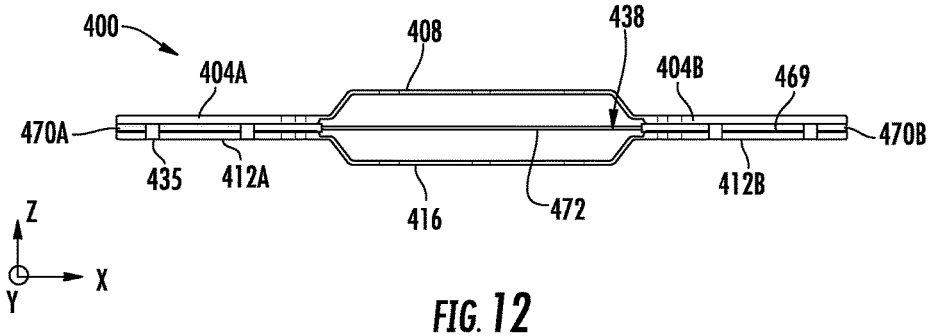
FIG. 12 is side view of the multiple element fuse of FIG. 11 following formation in accordance with embodiments of the present disclosure.

Turning now to FIGS. 11-12, a multiple-element fuse 400 (hereinafter "fuse") according to some embodiments of the present disclosure will be described in greater detail. As shown in FIG. 11, the fuse 400 includes a first fuse element 402 including a first pair of terminals 404A-B joined by a first fusible link 408, and a second fuse element 410 including a second pair of terminals 412A-B joined by a second fusible link 416. As shown, the first pair of terminals 404A-B are directly physically coupled with the second pair of terminals 412A-B, for example, by one or more linking elements 418, which are integrally formed with the first and second pairs of terminals 404A-B and 412A-B. The first and second pairs of terminals 404A-B and 412A-B may include respective terminal bodies 420A-D each having an opening 422 formed therein. The terminal bodies 420A-D are generally flat and include respective inner surfaces 424A-D, wherein the inner surfaces 424A-B of the first pair of terminals 404A-B and the inner surfaces 424C-D of the second pair of terminals 412A-B may be parallel to one another once the fuse 400 is formed. As shown, the terminal bodies 420A-D further include adjacent edges connecting inner surfaces 424A-D via the linking elements 418.

The fuse 400 may further include a third fuse element 469 including a third pair of terminals 470A-B directly physically coupled with at least one of the first pair of terminals 404A-B and the second pair of terminals 412A-B. In the embodiment shown, the third pair of terminals 470A-B are directly coupled to the second pair of terminals 412A-B by a set of linking elements 435. The third pair of terminals 470A-B may be further joined together by a third fusible link 472, which may be the same or different from the fusible links 408 and 416. In the embodiment shown, the third pair of terminals 470A-B may be folded about the linking elements 435, and sandwiched between the first pair of terminals 404A-B and the second pair of terminals 412A-B, as demonstrated in FIG. 12. The third fusible link 472 may be straight, or substantially straight, extend along a same x-y plane with the third pair of terminals 470A-B after the fuse 400 is formed. Stated another way, the shoulder regions 438 of the third fusible link 472 may not be bent like that of the first and second fusible links 408 and 416. However, the central regions of each of the first, second, and third fusible links 408, 416, and 472 may be spaced apart and parallel to one another along the z-direction when the fuse 400 is formed. It will be appreciated that additional terminal pairs/fusible links may be added to further increase thickness and strength the fuse 400.

In sum, the fuses of the present disclosure allow for simple fabricating processing, advantageously enhancing the productivity of fuse elements and fuses that contain them. Furthermore, the fuses may include multiple fusible links arranged in parallel, which advantageously splits a fusing current flow into multiple flows, thus reducing arc energy.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A multiple element fuse comprising:

a first fuse element including a first pair of terminals joined by a first fusible link;

a second fuse element including a second pair of terminals joined by a second fusible link, wherein the first pair of terminals is directly physically coupled with the second pair of terminals; and a linking element extending between interior edges of each terminal of the first and second pairs of terminals, wherein the linking element is directly coupled to just the first and second pairs of terminals, and wherein no linking element directly couples the first fusible link and the second fusible link.

2. The multiple element fuse according to claim 1, wherein the first pair of terminals and the second pair of terminals each comprises:

a terminal body including an inner surface and an outer surface, wherein the inner surface of the first pair of terminals and the inner surface of the second pair of terminals are parallel and in direct physical contact with one another; and an opening formed through the terminal body.

3. The multiple element fuse according to claim 2, the terminal body further including an edge connecting the inner surface and the outer surface, wherein the linking element is integrally formed with the edge.

4. The multiple element fuse according to claim 1, wherein the first fusible link and the second fusible link extend parallel to one another.

5. The multiple element fuse according to claim 1, wherein the first fusible link includes a first set of shoulder regions connected to the first pair of terminals, and wherein the second fusible link includes a second set of shoulder regions connected to the second pair of terminals.

6. The multiple element fuse according to claim 5, wherein the first and second sets of shoulder regions have a curved shape.

7. The multiple element fuse according to claim 1, wherein the first pair of terminals and the first fusible link extend parallel to one another along different planes.

8. The multiple element fuse according to claim 1, wherein the second pair of terminals and the second fusible link extend parallel to one another along different planes.

9. The multiple element fuse according to claim 1, further comprising a third pair of terminals joined by a third fusible link, wherein the third pair of terminals is directly physically coupled with at least one of: the first pair of terminals and the second pair of terminals.

10. A method of forming a multiple element fuse, comprising:

providing a first fuse element including a first pair of terminals joined by a first fusible link;

providing a second fuse element including a second pair of terminals joined by a second fusible link;

connecting the first pair of terminals to the second pair of terminals using a linking element, wherein the linking element is directly coupled to just the first and second pairs of terminals, and wherein no linking element directly couples the first fusible link and the second fusible link; and coupling the first pair of terminals directly to the second pair of terminals such that the first pair of terminals and the second pair of terminals are oriented parallel to one another along different planes.

11. The method according to claim 10, further comprising stacking the second fuse element atop the first fuse element.

12. The method according to claim 10, further comprising:

providing the first fuse element adjacent to the second fuse element, wherein the first and second fuse element each include inner surfaces extending along a same plane, and wherein the first and second fuse element are connected by the linking element; and directly coupling the inner surface of the first fuse element to the inner surface of the second fuse element.

13. The method according to claim 10, further comprising bending the linking element to cause the inner surface of the first fuse element to abut the inner surface of the second fuse element.

14. The method according to claim 10, further comprising:

providing the first fusible link with a first set of shoulder regions connected to the first pair of terminals and the second fusible link with a second set of shoulder regions connected to the second pair of terminals; and bending the first and second set of shoulder regions such that the first pair of terminals and the first fusible link extend parallel to one another along different planes and the second pair of terminals and the second fusible link extend parallel to another along different planes.

15. The method according to claim 10, further comprising providing a third pair of terminals joined by a third fusible link, wherein the third pair of terminals is directly physically coupled with at least one of: the first pair of terminals and the second pair of terminals.

16. A multiple element fuse comprising:

a first fuse element including a first pair of terminals joined by a first fusible link;

a second fuse element including a second pair of terminals joined by a second fusible link, wherein the first pair of terminals and second pair of terminals each include an inner surface and an outer surface, and wherein the inner surface of the first pair of terminals and the inner surface of the second pair of terminals are parallel and in direct physical contact with one another; and a linking element integrally formed with the first pair of terminals and the second pair of terminals, wherein the linking element is directly coupled to just the first and second pairs of terminals, and wherein no linking element directly couples the first fusible link and the second fusible link.

17. The multiple fuse element of claim 16, further comprising:

a first plurality of pairs of terminals including the first pair of terminals, wherein the first plurality of pairs of terminals are integrally coupled together and extend along a same plane; and a second plurality of pairs of terminals including the second pair of terminals, wherein the second plurality of pairs of terminals are integrally coupled together and extend along another same plane, and wherein the first plurality of pairs of terminals and the second plurality of pairs of terminals are parallel and stacked relative to one another.

* * * * *